5/1/84 XR 4,445,578

United States Patent [19]

Millheim

[11] 4,445,578

[45] May 1, 1984

[54] SYSTEM FOR MEASURING DOWNHOLE DRILLING FORCES

[75] Inventor: Keith K. Millheim, Tulsa, Okla.

[73] Assignee: Standard Oil Company (Indiana), Chicago, Ill.

[21] Appl. No.: 337,207

[22] Filed: Jan. 5, 1982

Related U.S. Application Data

[63] Continuation of Ser. No. 15,998, Feb. 28, 1979, abandoned.

[51] Int. Cl.[3] ..... E21B 7/06

[52] U.S. Cl. ..... 175/45; 73/151; 175/61

[58] Field of Search ..... 175/40, 45, 50, 39, 175/61; 299/1; 73/151, 151.5; 367/83

[56] References Cited

U.S. PATENT DOCUMENTS

| | | | |
|---|---|---|---|
| 2,930,137 | 3/1966 | Arps | 175/45 |
| 3,455,158 | 7/1969 | Richter, Jr. et al. | 175/39 |
| 3,713,089 | 1/1973 | Clacomb | 340/18 LD |
| 3,841,420 | 10/1974 | Russell | 175/45 |
| 3,855,853 | 12/1974 | Claycomb | 73/151 |
| 4,040,495 | 8/1977 | Kellner | 175/73 |
| 4,079,795 | 3/1978 | Sackman et al. | 175/27 |
| 4,190,124 | 2/1980 | Terry | 175/325 |
| 4,303,994 | 12/1981 | Tanguy | 175/45 |
| 4,324,297 | 4/1982 | Denison | 73/151 |

FOREIGN PATENT DOCUMENTS

| | | | |
|---|---|---|---|
| 2331252 | 1/1974 | Fed. Rep. of Germany | 73/151 |
| 387237 | 10/1973 | U.S.S.R. | 73/151 |

OTHER PUBLICATIONS

"Side Cutting Characteristics of Rock Bits and Stabilizers While Drilling" SPE, 7518, ©1978, Millhiem et al.

"Behavior of Multiple Stabilizer Bottom Hole Assemblies" Oil and Gas Journal, Jan. 1, 1979, pp. 59–64.

*Primary Examiner*—William F. Pate, III

*Attorney, Agent, or Firm*—Scott H. Brown; Fred E. Hook

[57] ABSTRACT

An apparatus is described whereby the side force on a drill bit can be measured during drilling operations and transmitted to the surface where it can be used in predicting trajectory of the hole and taking corrective action in the drilling operation. A downhole assembly using a downhole motor is modified to include means to detect the side thrust or force on a bit driven by the motor and the force on the deflection means of the downhole motor. These measured forces are transmitted to the surface of the earth during drilling operations and are used in evaluating and controlling drilling operations. Means are also provided to measure magnitude of the force on a downhole stabilizer.

35 Claims, 10 Drawing Figures

SYSTEM FOR MEASURING DOWNHOLE DRILLING FORCES

This is a continuation of application Ser. No. 15,998, filed Feb. 28, 1979, and now abandoned.

BRIEF SUMMARY OF THE INVENTION

This invention concerns a system for drilling wells in the earth and in particular wells drilled for oil and gas with a trajectory having a horizontal component. In one embodiment of many locations, and particularly in offshore locations where a large number of wells, e.g., 32, may be drilled from a single platform, the bottom of the individual wells may be located many thousands of feet horizontally from the position of the platform. In one embodiment of my invention, during drilling operations, I measure the force on the drilling bit perpendicular to its axis. An indication of this measured force is transmitted to the surface where it is used by the driller to control drilling operations so that the well takes the proper trajectory. Unless the bit is pulled, the functions which can be changed include changing the weight applied the bit, the rate of rotating the bit, and the hydraulics, all of which influences the direction the bit will go during drilling operations.

My invention can be used either with a system using a downhole motor or a system in which the bit is rotated by rotaing a string of drill pipe or a combination thereof.

My invention can also be used with a method for drilling a borehole in the earth in which a downhole motor having a rotating sub is provided with an orienting sub or cylinder connected to the downhole motor. The side thrust is measured during drilling operations on the rotating sub or bit and transmitted to the surface. I also measure the force between the orienting sub and the borehole wall which force measurement is also transmitted to the surface. These transmitted force measurements are then used at the surface to determine any corrective action which may be needed to the operation of the downhole motor and the orienting sub.

DRAWINGS

A better understanding of the invention can be had from the following description taken in conjunction with the drawings in which.

DETAILED DESCRIPTION

Figure 1:
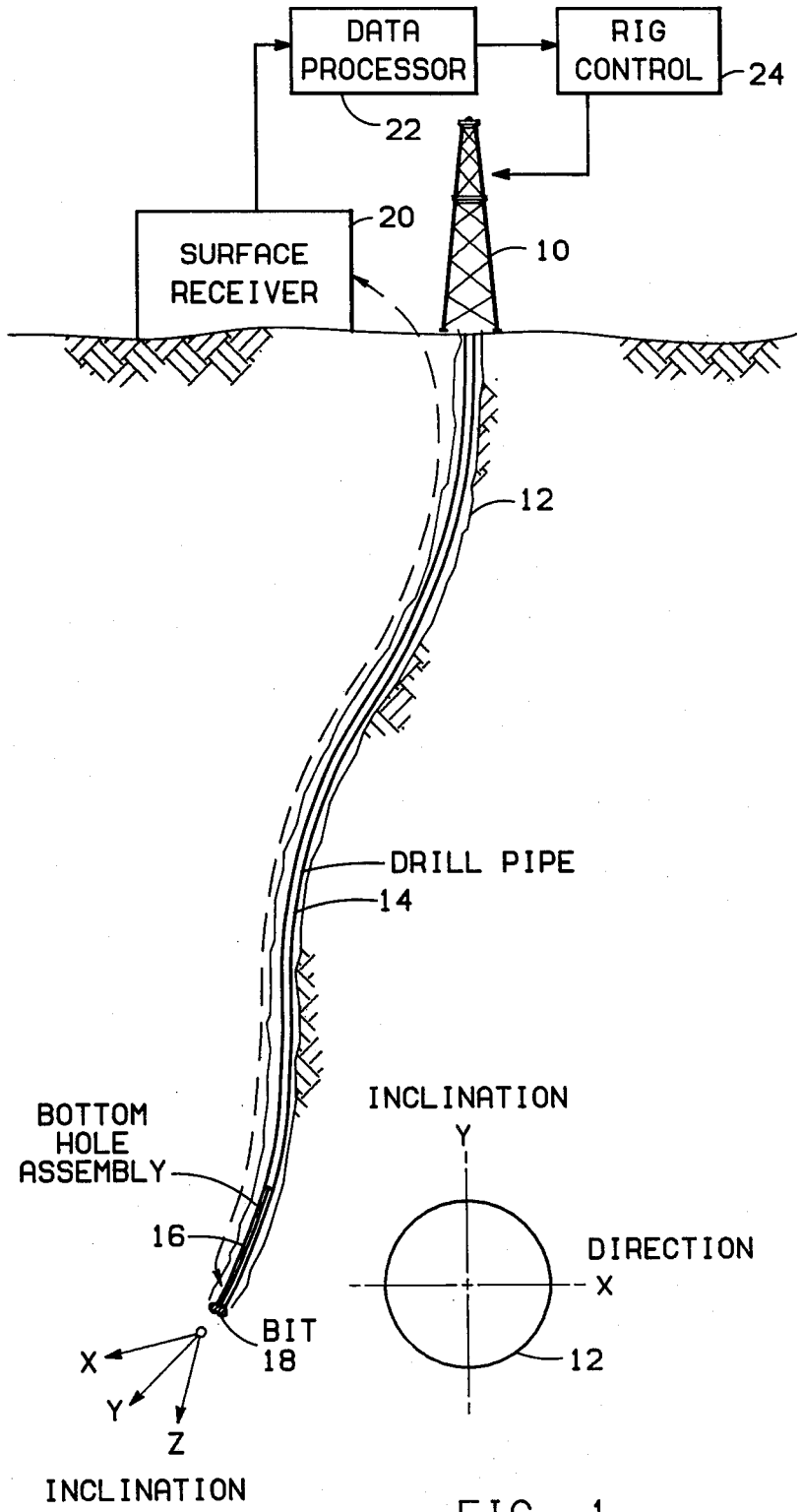
FIG. 1 illustrates a well being drilled in a controlled direction deviating from the vertical.

Attention is directed to FIG. 1 which illustrates a drilling rig 10 used for drilling borehole 12 and from which is suspended drillpipe 14 having a bottomhole assembly at the lower end. The bottomhole assembly 16 includes a bit 18 and suitable assessories such as stabilizers properly spaced. The borehole has three components, X, Y, and Z. X is the direction, Y the inclination, and Z is the axis of the borehole. Side thrust or forces are measured on the bottomhole assembly 16 and bit 18 by detection means shown in the other figures of the drawings. These side force measurements are transmitted to the surface receiver 20 and then to data processor 22. The information from surface receiver 20 will show the side force components X and Y. By knowing the side force components X and Y, one can determine the amount the bit will cut sideways in the next footage of hole drilled, e.g., 10 feet. The actual measurement of the resultant side force interaction can show many things to the driller. For example, if there is an exceedingly high side force on the bit, it shows that there is exceptionally high curvature to the hole at the point where it is being drilled. This may not be desirable and corrective action may need to be taken. An exceedingly high side force on the bit can also indicate the possibility of a transition zone or the starting of a severe dogleg situation. An example of an exceedingly high side force on a bit would be above 2000 lbs. it is thus clear that a knowledge of the side foce which is available during drilling is very useful.

Also, if we know the resultant side force and direction, one can determine the amount the bit will cut sideways with a relatively high degree of accuracy. For a discussion of this, see Millheim, K. K. and Warren, T., "Side Cutting Characteristics of Rock Bits and Stabilizers While Drilling", SPE preprint 7518, presented in the 1978 Annual Meeting of the SPE in Houston. That paper did not teach to measure the side force downhole nor how to do it but suggested a method of approximating or calculating the side force. Once an indication is given of the amount or prediction of how far the bit will cut horizontally in a given vertical measurement, one can then decide what corrective action if any is needed. Corrective actions include adjusting the weight on the bit and adjusting the rotary speed. For a discussion of how surface available adjustments can affect trajectory, see the article "Behavior of Multiple-Stabilizer Bottomhole Assemblies" by Keith Millheim, *The Oil and Gas Journal* Jan. 1, 1979. Direction of the side force can be determined by taking periodic measurements of the displacement of the bit in the inclination and direction planes (y and x). Systems by which this can be accomplished are available; for example, see U.S. Pat. No. 3,713,089, "Data-Signaling Apparatus for Well Drilling Tools", Jackson R. Clacomb, inventor, Schlumberger Technology Corporation, assignee.

Figures 2, 3, 4, 5:
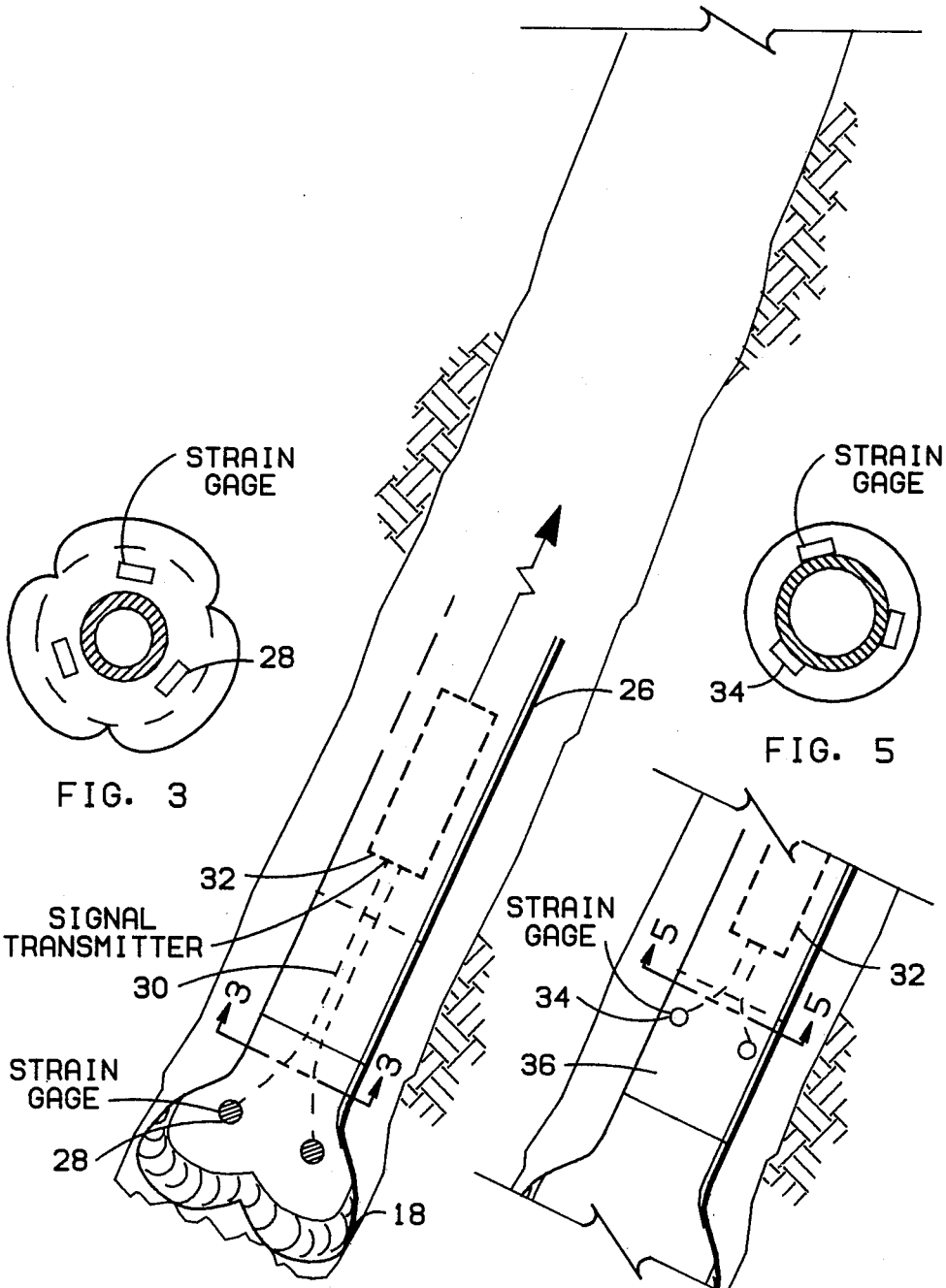
FIG. 2 illustrates a downhole drilling assembly incorporating one embodiment of my invention for measuring downhole side force during drilling.
FIG. 3 is a view taken along the line 3—3 of FIG. 2.
FIG. 4 illustrates a modification of the location of the strain gauges of the apparatus of FIG. 2.
FIG. 5 is a view taken along the line 5—5 of FIG. 4.

Attention is now directed to FIG. 2 which illustrates a modification of a down hole drilling apparatus for detecting and transmitting side force on a bit. Shown thereon is a bit 18 connected to drill collars 26 which is connected to drillpipe 14 not shown in FIG. 2. As shown in FIGS. 2 and 3, there are three strain gauges 28 mounted about the legs of drill bit 18. These strain gauges should be equally spaced about the circumference of the drill bit. As shown in FIG. 3, if there are three strain gauges used, they should be approximately 120° apart. These strain gauges should be positioned to detect force or displacement on the bit shank. Each strain gauge 28 is connected by appropriate conduits 30 to a signal transmitter 32. The signal transmitter 32 is used to transmit the signal to surface receiver 20 as shown in FIG. 1. One type signal transmitter is described in U.S. Pat. No. 3,713,089, supra. It is apparent that by knowing the forces in three or more different parts of the bit which are equally spaced that one can readily determine the resultant side force on the bit. It is considered simplest to transmit the measurement of each strain gauge 28 to the surface and make the calculation or determination at the surface.

Attention is next directed at FIG. 4 which shows a slightly different embodiment than that of FIG. 2 for use in determining the side force on the bit. Shown in FIGS. 4 and 5 are a plurality of strain gauges 34 which are positioned on bit sub 36. The measurements from each strain gauge 34 is then transmitted to the surface through signal transmitter 32, and this signal is used at the surface to aid in drilling the well as indicated above.

The most common method of drilling for oil and gas is by use of the rotary drilling method. As is well-known in that system a bit is suspended at the lower end of a string of tubing and the bit is rotated by rotating tubing or drill pipe at the surface. Another form of drilling which is used quite frequently in directional drilling is the use of a downhole motor. The downhole motor is suspended at the lower end of a string of drill-pipe or tubular member. However, in this case a drill-pipe is not usually rotated and the rotation of the bit is provided by a hydraulic or electric motor. When this type system is used in directional drilling, there is also usually provided an orienting sub or deflection barrel to apply lateral force to the side of the housing of the motor in order to aid in getting the bit to drill in the desired direction and inclination. One such system is described in U.S. Pat. No. 4,040,495, "Drilling Apparatus," Kellner, et al., inventors.

Figure 7:
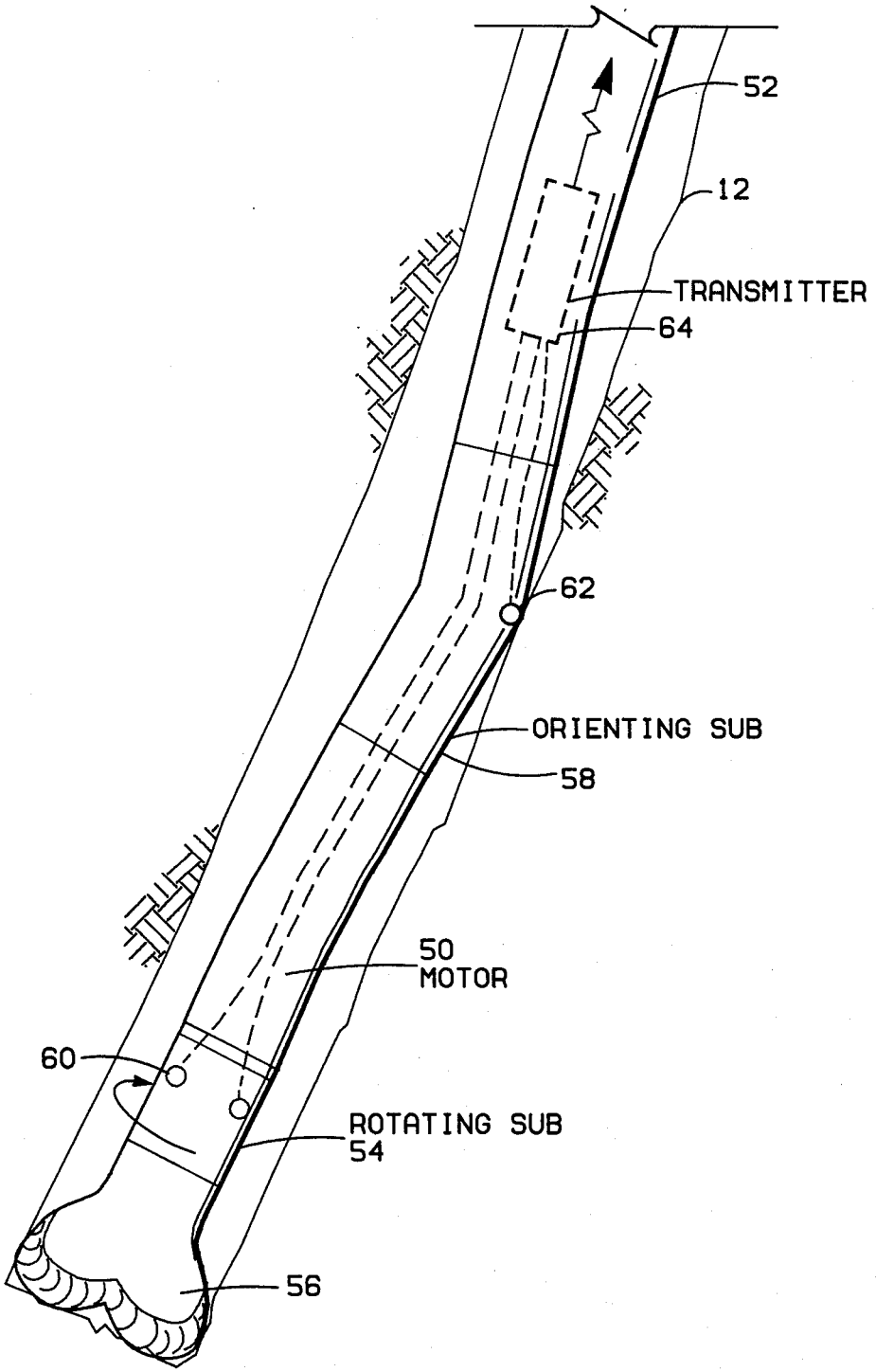
FIG. 7 illustrates a modification of a downhole drill motor and associated deflection means modified to obtain measurements of the side forces at key positions.

Attention is next directed to FIG. 7 which illustrates a downhole assembly having a downhole motor for rotating a drill bit that has been modified in accordance with my invention. Shown in FIG. 7 is a downhole motor 50 attached to the lower end of a string of drill pipe or tubing 52. The motor 50 is connected to a rotating sub 54 which has bit 56 which is used for drilling. Also used with a motor 50 is an orienting sub 58.

Means are provided to detect the side force on the rotating sub 54 and on the orienting sub 58 of the downhole assembly of FIG. 7. Strain gauges 60 are provided in rotating sub 54 and can be positioned similarly to that shown in FIG. 5. A strain gauge or load cell 62 is provided to make a measure of the force exerted between the orienting sub 58 and the borehole wall. Each strain gauge 60 and load cell 62 is connected to transmitter 64 so that a reading of each strain gauge can be transmitted to the surface for use. If the apparatus of U.S. Pat. No. 4,040,495 were used, load cell 62 would be provided on deflection barrel 41. The point on which the orienting or deflecting sub 58 contacts the borehole wall 12 determines to a large extent the direction in which bit 56 will go in drilling. The circumferential position of this point of contact can be changed without pulling the tool from the hole. For example, in said U.S. Pat. No. 4,040,495, deflector barrel 41 can be rotated to any desired circumferential position within the wellbore. Knowing the side force on the orienting sub 58 and on bit 56 assists the drilling in determining or predicting the trajectory in which the hole will be made. If the prediction is different from the desired trajectory of the hole, corrective action can be taken prior to drilling that part of the hole. This permits corrective action to be taken before the hole is drilled rather than waiting until the hole is drilled and determining what action should have been taken when it is too late. It should be noted that the term deflection means when used in connection with the downhole assembly as described in this invention would include the bent or orienting sub as illustrated in FIG. 7 or a deflection barrel or any other downhole means used with a rotating drilling bit to guide its trajectory.

Figure 6:
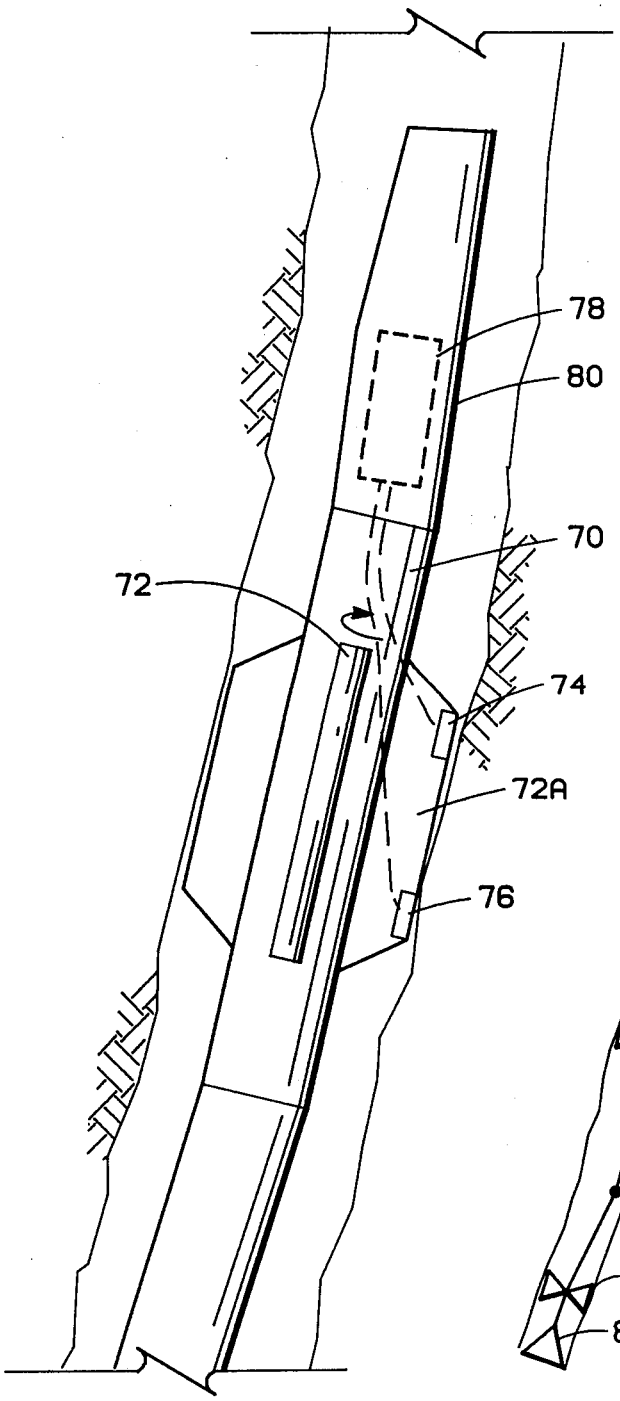
FIG. 6 illustrates a modification of downhole stabilizers.

Most downhole assemblies used in drilling operations contain or include what is known as a stabilizer. Shown in FIG. 6 is one such stabilizer 70 having four equally spaced longitudinal blades 72. Stabilizers are well known and can take various forms. As shown in FIG. 6 on blade 72A, there are spaced longitudinally an upper strain gauge 74 and a lower strain gauge 76. They are each connected independently to transmitter 78. Stabilizer 70 is connected to a drill collar 80. Strain gauges 74 and 76 are aligned. This will give a measure of the difference in side force at two longitudinally spaced points on the stabilizer. This is useful in determining hole trajectory.

Figure 10:
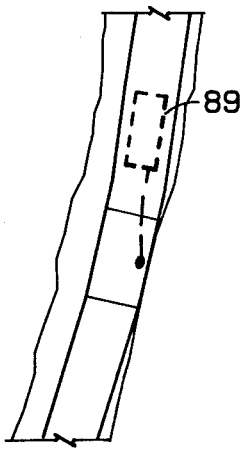
FIG. 10 illustrates an enlarged portion of the drill colors showing the addition of a strain gauge or load cell.
Figure 8:
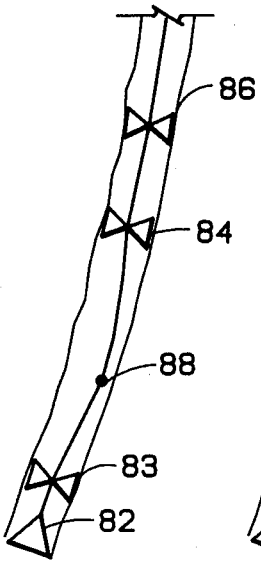
FIG. 8 illustrates a modified downhole building assembly.
Figure 9:
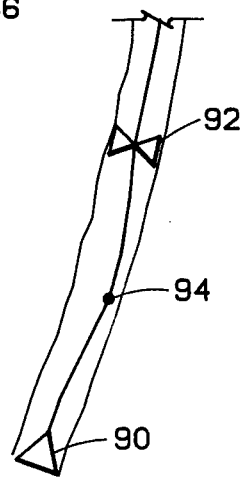
FIG. 9 illustrates a modified downhole dropping assembly.

Attention is next directed to FIG. 8 which shows a downhole building assembly, e.g., one which would increase the angle of the hole from the vertical. This ssembly includes bit 82, and stabilizers 83 and 84 and 86 mounted on a drill string section which may comprise drill collars. A load cell 88 is provided between stabilizers 83 and 84. The output from load cell 88 can be used to determine when that part of the drill pipe or drill collars between stabilizers 83 and 84 becomes tangent with the borehole wall. This would be a signal that no more weight should be applied to the drill bit. The principle of my invention can also be appliwed to the embodiment of FIG. 9 which illustrates a downhole dropping assembly which includes a bit 90, a stabilizer 92 and a load cell 94 therebetween on the connecting drill collar or pipe 93. Load cell 94 serves a purpose similar to that of load cell 88. As illustrated in FIG. 10, the measured values from the load cells is transmitted by transmitter 89 to the surface. For a discussion of the spacing of stabilizers in downhole assemblies see the article "Behavior of Multiple-Stabilizer Bottomhole Assemblies," supra.

While the above system has been described in detail, various modifications can be made thereto without departing to the spirit or scope of the invention.

What is claimed:

1. An apparatus connected to a drill string for use in drilling a borehole in the earth comprising:

a drill bit connected to said drill string;

a subunit connected to said drill string and said drill bit;

at least three circumferentially spaced means for measuring strain on said subunit to measure an indication of the force on said subunit perpendicular to its axis; and means for processing the indications of force obtained by said means for measuring strain to obtain the sideforce on said drill bit.

2. An apparatus as in claim 1 including a signal transmitter means connecting said means for measuring strain to said means for processing.

3. An apparatus connected to a drill string for use in drilling a borehole in the earth comprising:

a drill bit connected to said drill string;

at least three circumferentially spaced means for measuring strain on said drill bit to measure an indication of the force on said drill bit perpendicular to its axis; and means for processing the indications of force obtained by said means for measuring strain to obtain the sideforce on said drill bit.

4. An improved apparatus connectable to a drill string for use in drilling a hole in the earth comprising:

(a) a drill bit connectable in said drill string, (b) at least three circumferentially equally spaced strain gauges on the shank of said bit arranged to measure an indication of the force on said bit perpendicular to its axis, and (c) means for processing the force obtained by element (b) to obtain the side force on said bit.

5. An apparatus as in claim 3 including a signal transmitter means connecting said means for measuring strain to said means for processing.

6. An apparatus as defined in claim 4 including a signal transmitter means connecting said strain gauges to said transmitter.

7. A method of drilling a borehole in the earth using a drill string and a drill bit, comprising:

(a) during downhole drilling operations measuring the force between said drill bit and the borehole wall, (b) processing the measured force of step (a) to obtain the sideforce on said drill bit, and (c) using said sideforce obtained in step (b) to control the trajectory of said drill bit.

8. A method of drilling a hole in the earth using a drill string and a drill bit which comprises:

(a) during downhole drilling operations measuring the force between said bit and the borehole wall, (b) processing the measured force of step (a) to obtain the side force on said bit, and (c) using said side force obtained in step (b) to control the trajectory of the drill bit.

9. A method as in claim 7 including transmitting the measured force to the surface for processing.

10. A method as defined in claim 8 including transmitting the measured force to the surface for processing.

11. An apparatus for use in drilling a borehole in the earth comprising:

a downhole motor connected to a drill bit;

at least three circumferentially spaced measuring means on said bit to measure the sideforce on said drill bit during drilling;

means for deflection interconnected with said downhole motor;

means for measuring the force between said means for deflection and the borehole wall; and means for transmitting an indication of the forces measured by said measuring means on said drill bit and said means for deflection to the surface of the earth.

12. An apparatus as in claim 11 wherein said means for deflection is a deflection barrel.

13. An apparatus as in claim 11 wherein said measuring means are load cells.

14. A method of drilling a borehole in the earth using a downhole motor connected to drill bit and a means for deflection connected to said downhole motor, comprising:

(a) measuring the sideforce on said drill bit during drilling operations;

(b) transmitting an indication of the measured sideforces obtained in step (a) to the surface of the earth;

(c) measuring the force between said means for deflection and said borehole wall;

(d) transmitting indications of the force measured in step (c) to the surface of the earth; and (e) determining the effect of the sideforce measured in step (a) and the force measured in step (c) on the predicted trajectory of the borehole and positioning said means for deflection in accordance with such determination.

15. A method of drilling a borehole in the earth using a downhole motor connected to a bit and a deflection means connected to said downhole motor comprising:

(a) measuring the side force on said bit during drilling operations, (b) transmitting an indication of the measured side forces in Step (a) to the surface of the earth, (c) measuring the force between said deflection means and said borehole wall, (d) transmitting indications of the force measured in Step (c) to the surface of the earth, (e) determining the effect of the side force measured in Step (a) and the force measured in Step (c) on the predicted trajectory hole and positioning said deflection means in accordance with such determination.

16. An apparatus for use in drilling a borehole in the earth comprising:

a downhole motor having a rotating sub attachable to a drill bit, said sub and drill bit forming a rotating unit;

at least three circumferentially spaced means for measuring strain on said rotating unit;

means for deflection connected to said downhole motor;

means for measuring force mounted on said means for deflection to measure the force between said means for deflection and the borehole wall; and means to transmit to the surface of the earth signals from the means for measuring strain and said means for measuring force.

17. An improved apparatus for use in drilling a hole in the earth comprising:

(a) a downhole motor having a rotating sub attachable to a drill bit, said sub and bit forming a rotating unit, (b) at least three circumferentially spaced strain gauges on said rotating unit, (c) a deflection means connected to said downhile motor, (d) a gauge means mounted on said deflection means for measuring the force between said deflection means and the wall of said hole, (e) means to transmit to the surface of the earch indications of signals from the strain gauges on said rotating unit and gauge means on said deflecting means.

18. An apparatus as in claim 16 wherein said means for measuring strain are strain gauges.

19. An apparatus as in claim 18 wherein said means for measuring force are load cells.

20. A method of drilling a borehole in the earth using a downhole motor having a rotating sub connected to a drill bit and means for deflection connected to said downhole motor, comprising:

(a) measuring an indication of the strain on said rotating sub at at least three circumferentially spaced locations;
(b) transmitting an indication of the strain measured in step (a) to the surface of the earth;
(c) measuring the force between said means for deflection and said borehole wall; and
(d) transmitting an indication of the force measured in step (c) to the surface of the earth.

21. A method of drilling a borehole in the earth using a downhole motor having a rotating sub connected to a bit snd a deflecting means connected to the housing of said downhole motor, comprising:
(a) measuring an indication of the strain in said rotating sub at at least three circumferentiallyspaced locations,
(b) transmitting an indication of the strain measured in Step (a) to the surface of the earth,
(c) measuring the force between said deflection means and said borehole wall,
(d) transmitting an indication of the force measured in Step (c) to the surface of the earth.

22. A downhole assembly for use in drilling a wellbore comprising:
a drill string section;
a first stabilizer mounted on said section,
a second stabilizer mounted on said section above said first stabilizer, and
means for measuring force positioned on the exterior of said section between said first and said second stabilizers.

23. A downhole assembly for use in drilling a wellbore comprising:
a drill string section,
a bit supported at the lower end of said section,
a first stabilizer mounted on said section near said bit,
a second stabilizer mounted on said section above said first stabilizer, and
a load cell means positioned on the exterior of said section between said first and second stabilizers.

24. A downhole assembly for use in drilling a wellbore comprising:
a drill string section;
a first stabilizer mounted on said section;
a second stabilizer mounted on said section above said first stabilizer; and
means for measuring strain positioned on the exterior of said section between said first and said second stabilizers.

25. A downhole assembly as in claims 22 or 24 including a drill bit supported at the lower end of4said drill string section and said drill bit including means to measure the sideforce on a said drill bit perpendicular to its axis.

26. A downhole assembly as defined in claims 23 or 24 including means to measure the side force on said bit perpendicular to its axis.

27. A method of drilling a borehole in the earth using a drill bit interconnected with a drill string section, having an upper and a lower stabilizer connected thereto, comprising:
(a) measuring the force between the borehole wall and the drill string section at a position between said upper and said lower stabilizers; and
(b) transmitting the indication of the force measured in step (a) to the surface of the earth.

28. A method of drilling a borehole in the earth using a drill bit interconnected with a drill string section having an upper and a lower stabilizer connected thereto, comprising:
(a) measuring the strain on said drill string section at a position between said upper and said lower stabilizers; and
(b) transmitting an indication of the strain measured in step (a) to the surface of the earth.

29. A downhole assembly for use in drilling a wellbore comprising:
a drill string section;
a stabilizer mounted on said drill string section; and
at least one means for measuring force positioned on the exterior of said drill string section between the lower end thereof and said stabilizer.

30. A downhole assembly for use in drilling a wellbore comprising:
a drill string section,
a bit supported at the lower end of said section,
a stabilizer mounted on said section above said bit,
a load measuring means positioned on the exterior of said section between said bit and said stabilizer.

31. A downhole assembly for use in drilling a wellbore comprising:
a drill string section;
a stabilizer mounted on said drill string section; and
at least one means for measuring strain positioned on the exterior of said section between the lowr end thereof and said stabilizer.

32. A downhole assembly as in claim 29 wherein said means for measuring force are load cells.

33. A downhole assembly as in claim 31 wherein said means for measuring strain are strain gauges.

34. Method of drilling a wellbore in the earth using a drill bit interconnected with a drill string section having a stabilizer connected thereto, comprising:
(a) measuring the force between the borehole wall and the drill string section at a position between the stabilizer and the drill bit; and
(b) transmitting an indication of the force measured in step (a) to the surface of the earth.

35. A method of drilling a wellbore in the earth using a drill bit interconnected with a drill string section having a stabilizer connected thereto, comprising:
(a) measuring the strain on said drill string section at a position between the stabilizer and the drill bit; and
(b) transmitting an indication of the strain measured in step (a) to the surface of the earth.

* * * * *